US008978890B2

(12) United States Patent
Ludwig et al.

(10) Patent No.: US 8,978,890 B2
(45) Date of Patent: Mar. 17, 2015

(54) SECURITY LABEL FOR PROTECTING MEDICAMENTS CONTAINED IN AN INDIVIDUAL PACKAGING

(75) Inventors: Frank Ludwig, Melsungen (DE); Reinhard Kuge, Melsungen (DE); Marco Dieling, Felsberg (DE)

(73) Assignee: Faubel & Co Nachfolger GmbH (DE)

( * ) Notice: Subject to any disclaimer, the term of this patent is extended or adjusted under 35 U.S.C. 154(b) by 108 days.

(21) Appl. No.: 13/394,497

(22) PCT Filed: Aug. 31, 2010

(86) PCT No.: PCT/DE2010/001024

§ 371 (c)(1),
(2), (4) Date: Apr. 20, 2012

(87) PCT Pub. No.: WO2011/029423

PCT Pub. Date: Mar. 17, 2011

(65) Prior Publication Data

US 2012/0228185 A1 Sep. 13, 2012

(30) Foreign Application Priority Data

Sep. 8, 2009 (DE) ..... 20 2009 012 193 U

(51) Int. Cl.

| | |
|---|---|
| ***B65D 83/04*** | (2006.01) |
| ***G09F 3/00*** | (2006.01) |
| ***A61J 1/03*** | (2006.01) |
| ***B65D 75/36*** | (2006.01) |

(52) U.S. Cl.

CPC ..... *G09F 3/0292* (2013.01); *A61J 1/03* (2013.01); *B65D 75/367* (2013.01); *A61J 1/035* (2013.01); *B65D 2215/00* (2013.01); *B65D 2575/367* (2013.01)

USPC ..... 206/532; 206/539

(58) Field of Classification Search

USPC ..... 206/528, 530–533, 538, 539

See application file for complete search history.

(56) References Cited

U.S. PATENT DOCUMENTS

| | | | | |
|---|---|---|---|---|
| 3,630,346 | A * | 12/1971 | Burnside | 206/532 |
| 3,759,371 | A * | 9/1973 | Marks | 206/531 |
| 4,988,004 | A | 1/1991 | Intini | |

(Continued)

FOREIGN PATENT DOCUMENTS

| | | |
|---|---|---|
| DE | 10 2007 017856 A1 | 10/2008 |
| WO | WO 2004/085266 | 10/2004 |

OTHER PUBLICATIONS

International Search Report dated Jan. 28, 2011 issued in corresponding international patent application No. PCT/DE2010/001024.

*Primary Examiner* — Bryon Gehman

(74) *Attorney, Agent, or Firm* — Ostrolenk Faber LLP

(57) ABSTRACT

The invention relates to a security label for protecting medicaments contained in an individual packaging, comprising a base layer (11, 111, 211) that can be stuck to the individual packaging (10, 110), at least one opening cut (26, 226) being formed in the base layer (11, 111, 211), in the region of the medicament (16). A security layer (10, 110) is stuck to the base layer (11, 111, 211), and removable elements (19) are formed in the security layer (10, 11) in the region of the medicaments (16), in such a way that cuts (18) are made in the security layer (10, 110) on the edge of the removable elements (19), said cuts (18) following a virtual cut strip. Furthermore, a release material which reduces or eliminates the adhesive force of the adhesive of the security layer (10, 110) is applied to the base layer (11, 111, 211) in the region of the removable elements (19).

22 Claims, 4 Drawing Sheets

(56) References Cited

U.S. PATENT DOCUMENTS 5,785,180 A 7/1998 Dressel et al.
7,063,211 B2 * 6/2006 Williams-Hartman ..... 206/532
7,188,728 B2 * 3/2007 Williams-Hartman ..... 206/532
7,448,496 B2 * 11/2008 Williams-Hartman ..... 206/532
7,665,610 B2 * 2/2010 Williams-Hartman ..... 206/532
7,905,355 B2 * 3/2011 Williams-Hartman ..... 206/532

* cited by examiner

SECURITY LABEL FOR PROTECTING MEDICAMENTS CONTAINED IN AN INDIVIDUAL PACKAGING

CROSS REFERENCE TO RELATED APPLICATIONS

The present application is a 35 U.S.C. §371 National Phase conversion of PCT/DE2010/001024, filed Aug. 31, 2010, which claims benefit of German Application No. 20 2009 012 193.3, filed Sep. 8, 2009, the disclosure of which is incorporated herein by reference.

BACKGROUND ON THE INVENTION

The present invention relates to a safety/security label for protecting medicaments contained in an individual packaging.

Blister packaging comprises a number of troughs, in which in each case one medicament is packaged using a covering film, typically made of aluminum. This covering film can be readily pierced, with the result that the medicament drops out or can be removed. As a result, there is a risk that the aluminum foil covering the medicaments accidentally tears open and the medicament either becomes dirty or is lost, or there is a risk that the aluminum foil is opened by unauthorized persons, for example by small children while playing, and that the children then swallow these medicaments. To protect such an individual packaging of medicaments (blister packaging), DE 10 2007 017 856 A1 proposes a label, which comprises a base sheet, which is adhesively bondable to the blister packaging, and a cover sheet, which is adhesively bonded to the base sheet. This cover sheet is permanently adhesively bonded to the base sheet only in the region of its bond, while the majority of the cover sheet sticks to the base sheet in a releasable and re-closable fashion owing to a silicone varnish layer on the upper surface of the base sheet. Provided in the base sheet in the region of the medicaments of the blister packaging are longitudinal slits or cross slits, through which the individual medicament can be pushed up in order to remove it.

It has been found, however, that although blister packaging, which is reinforced by a label as per DE 10 2007 017 856 A1, does provide some protection against unauthorized opening by children or some protection against accidental opening of the individual packaging, this resistance to opening by children no longer satisfies today's standards. In particular no "F1" safety rating is achieved, at which children must not take more than a single medicament from the blister packaging within a specified period of time.

SUMMARY OF THE INVENTION

Proceeding from this, the present invention is based on the object of providing a safety label of the type mentioned at the outset which can be opened easily by a patient while offering high protection against unauthorized opening by children or accidental opening and can be produced in a cost-effective manner.

As a technical way of achieving this object, the invention proposes a safety label of the type mentioned in the introduction.

A safety label configured according to this technical teaching has the advantage that, owing to the safety sublayer that is adhesively bonded to the base sublayer, two layers are available which are adhesively bonded to the aluminum foil of the individual packaging. As a result, two additional layers are available, as a result of which accidental opening of an individual medicament trough can be reliably prevented.

The configuration of the pull-off elements inside the safety sublayer and in particular the use of the means for reducing or canceling the adhesion force in the region of the pull-off elements has the advantage that these pull-off elements can be removed by the patient without undue effort, such that thereafter only the base sublayer is left over the relevant medicament trough, and that good resistance to opening by children is still achieved. Moreover, the base sublayer is weakened by way of opening cuts, such that in this case, too, the patient can be expected to push out the medicament through the aluminum foil of the blister and the base sublayer weakened by the cuts without undue effort. At the same time, the cooperation between the base sublayer with the safety sublayer and the adhesively bonded blister produces an obstacle which makes it extremely difficult for small children to access the medicaments.

It has proven advantageous in this case to use a silicone-containing varnish to reduce the adhesion force, since said varnish sufficiently weakens the adhesion force without completely canceling the adhesive action.

In one preferred embodiment, impeding areas are provided on the cutting path, which impeding areas act as resistance to the pulling-off of the pull-off element. This has the advantage that, owing to the impeding areas situated on the cutting path, the resulting resistance is so large that accidental pulling off of the pull-off element by children is made more difficult and that accidental pulling off of the pull-off elements is made almost impossible.

In one preferred embodiment, the impeding areas are configured as a retaining web, which is formed between two cuts, or as a cross cut or as a curve. Any of these impeding areas make the pull-off operation more difficult in their own way: a retaining web owing to the material connection between pull-off element and safety sublayer, which connection must first be destroyed, a cross cut owing to the deflection of the pull-off motion in two directions, which are both undesired, and a curve owing to the reversal of the pull-off motion. In this case, a cross cut is arranged orthogonal to the edge of the pull-off element.

It can be appreciated that, while the pull-off element is pulled off, the cuts offer almost no resistance at all, whereas the impeding areas bring a completing pull-off motion to an abrupt stop, with the result that the pull-off element can be pulled off further only against significant resistance.

Depending on the application requirement, a plurality of impeding areas can be formed at the periphery of the pull-off element. It is possible to adjust the resistance during pulling off of the pull-off element, which is necessary in each individual case, by way of the number of these impeding areas.

It has proven particularly advantageous to arrange a retaining web between a cut and a cross cut, since this synergistically increases the resistance action, with the result that the desired resistance is attained with simple, cost-effective means.

In another, preferred embodiment, the cutting path has a curvature of between 30° and 120°, in particular between 70° and 100°, preferably 90°. This has the advantage that the user must change the pull-off direction during the pull-off operation. This, however, succeeds only in the case of considerable motor skills, which are present in adults but not in small children. As a result, this provides good resistance to opening by children.

In another, preferred embodiment, the cutting path has a curve of between 140° and 200°, in particular between 160° and 180°. This has the advantage that the user must at least nearly reverse direction during the pull-off operation. This succeeds only in the case of considerable motor skills, which are present in adults but not in small children. As a result, this provides good resistance to opening by children.

A further advantage is that the resistance is very much greater in the region of a curve than the resistance offered by an impeding area. As a result, the pull-off operation at least temporarily stops in such a curve, while the pull-off operation can be continued for the remainder. Such a curve can thus be used to control the pull-off operation.

In another preferred embodiment, a gripping lug is formed on the pull-off element, wherein the gripping lug is completely surrounded by a cut or a microperforation, without an impeding area being present there. This has the advantage that the gripping lug can be freed relatively easily from the safety position, with the result that the pull-off element can be gripped by this gripping lug and then pulled off entirely. A further advantage is that small children, owing to their not yet fully developed motor skills, will find it difficult to find this gripping lug, to free it and to grip it. Consequently, this ensures relatively good resistance to opening by children, while the gripping lug represents no obstacle to an adult patient.

In a further, preferred embodiment, a holding lug is formed on the pull-off element. This holding lug, and all other edges of the pull-off element as well, are provided with cuts and impeding areas.

It has proven advantageous to form a U-shaped or V-shaped curve between the holding lug and the gripping lug. This has the advantage that the motion during pull-off of the pull-off element is virtually stopped in this curve, because the pull-off motion comes to a stop in the deepest point of the curve. In order to be able then to pull off the pull-off element further, first the pull-off direction needs to be changed drastically here, which in the normal case necessitates effort and requires a high level of motor skills. Consequently, the pull-off operation is first resumed at the other locations of the pull-off element, such that the holding lug is pulled off last.

In one advantageous development, the gripping lug extends all the way into the curve, with the result that the gripping lug of the pull-off element can be freed quickly and easily from the safety position, although in this case very soon the above-described resistance then occurs when pulling off the pull-off element, with the result that the pull-off element is pulled off first on that side of the pull-off element that is located opposite the holding lug.

Formed on that side of the pull-off element that is located opposite the holding lug is the cutting path, curved by 90°. This has the advantage that the user, when pulling off the pull-off element and after the pull-off operation has come to a stop in the region of the curve, then has to pull off the pull-off element along the curve. However, in doing so the user must follow the curved cutting path and change the pull-off direction along the curve by 90°. This requires a high level of dexterity, which is generally not present in children. As a result, children should be unable to remove this pull-off element, even though the adhesive bond with the base sublayer is strongly weakened owing to the silicone varnish.

In another, preferred embodiment, the opening cuts in the base sublayer are configured in the shape of a T. This has the advantage that a relatively small opening is provided, such that it helps in pushing out the medicament, but the rest of the base sublayer comprises a contiguous sheet which must be torn when the medicament is pushed out. The resulting resistance makes it more difficult for children to accidentally push the medicament out or to open the blister without authorization.

Another advantage of the T-shaped opening cut is that the latter covers only a relatively small area, and consequently the majority of the medicament trough is closed. It also makes accidental opening more difficult, because first of all the location with the T-shaped opening cut must be encountered in this case. Unauthorized opening by children is made more difficult, too, because children will not necessarily push out the medicament at the T-shaped opening cut when playing either. However, at the same time it is possible for the patient to notice that the medicament must be pushed out at the location where the T-shaped opening cut is located, and the patient can thus remove the medicament in the manner known per se and without effort.

In one preferred embodiment, two, three or four T-shaped opening cuts are provided in the base sublayer of the safety label. The level of difficulty and resistance when pushing the medicament out can be adjusted by way of the number of the T-shaped opening cuts depending on the situation, because sometimes patients are no longer strong enough, on account of their illness, to remove the medicaments in case of high resistance.

In one particularly preferred embodiment, the horizontal portions of the T-shaped opening cuts are arranged on a virtual segment of a circle. In this case, the segment of a circle is advantageously arranged such that it is concentric to the contour of the medicament trough of the individual packaging. Ideally, the horizontal portion of the T-shaped opening cut is located tangentially on the segment of a circle, while the vertical portion of the T-shaped opening cut is oriented radially with respect to the center.

This has the advantage that the base sublayer can be opened in this segment of a circle, wherein the material remaining between the T-shaped opening cuts still offers a fair amount of resistance.

When the medicament is pushed out, it first encounters the horizontal portion such that the base sublayer then opens, owing to the vertical portion, toward the center of the medicament trough, with the result that controlled opening and removal of the medicament is ensured.

In practice, it has been found that the ratio of vertical portion to horizontal portion should be between 0.3 and 2 in order to offer sufficient resistance while still enabling weaker persons to remove the medicaments.

In one very particularly preferred embodiment, a cover sheet which is at least mostly detachable is attached to the safety sublayer. Information pertaining to the medicament can be printed onto said cover sheet. If this cover sheet is configured such that it is re-closable, it is also possible to attain a very neat and tidy appearance of the entire individual packaging, with the result that the individual packaging according to the invention has a pleasing appearance even after repeated use.

BRIEF DESCRIPTION OF THE DRAWINGS

Further advantages of the safety label according to the invention can be gathered from the attached drawing and the embodiments described below. The abovementioned features and those described below can also be used, according to the invention, in each case individually or together in any desired combination. The embodiments mentioned should not be understood to constitute a complete list but rather to have an exemplary character.

DESCRIPTION OF PREFERRED EMBODIMENTS

Figure 1:
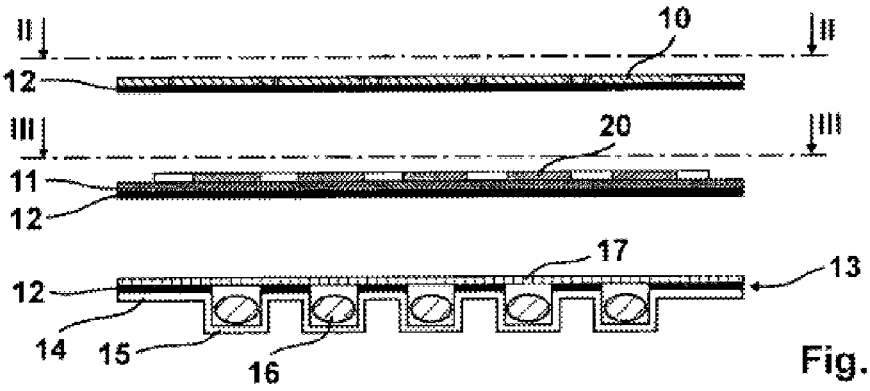
FIG. 1 shows an exploded view, illustrated in cross-section, of a first embodiment of a safety label according to the invention with blister packaging, the cross-section being viewed along section lines I-I in FIG. 2.
Figure 2:
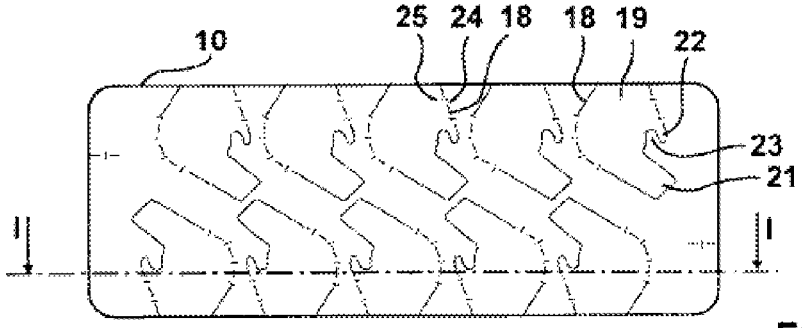
FIG. 2 shows a plan view of the safety label according to FIG. 1, viewed along lines II-II in FIG. 1.
Figure 3:
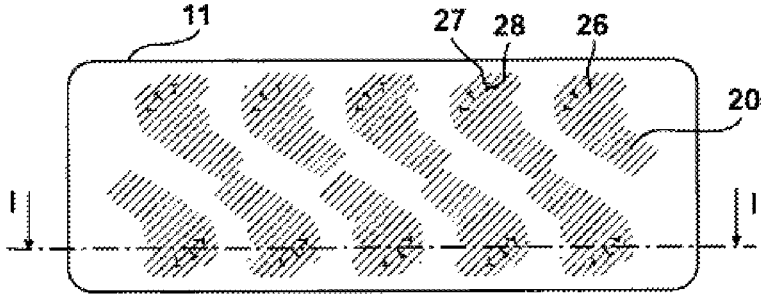
FIG. 3 shows a plan view of the base sublayer of the safety label according to FIG. 1, viewed along lines III-III in FIG. 1.
Figure 4A:
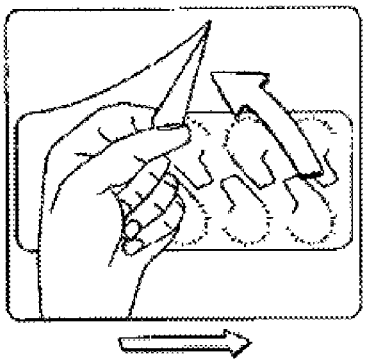
FIG. 4*a* to FIG. 4*e* show a schematic illustration of the sequence when removing a medicament from an individual packaging with the safety label according to the invention.
Figure 4B:
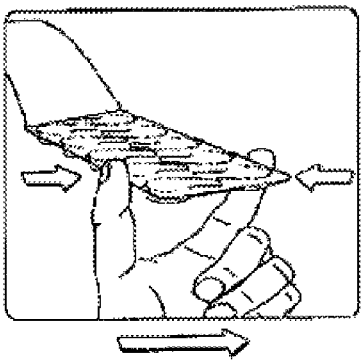
Figure 4C:
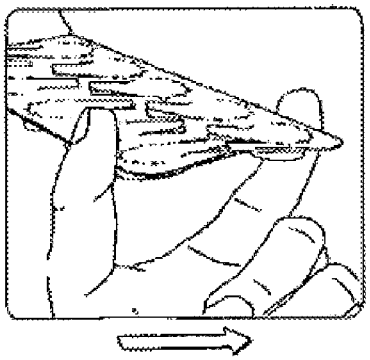
Figure 4D:
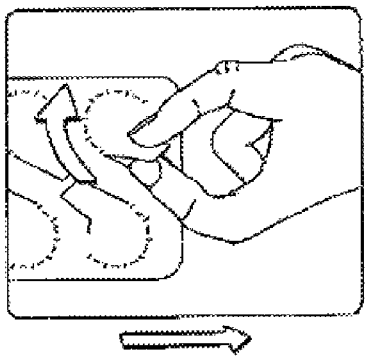
Figure 4E:
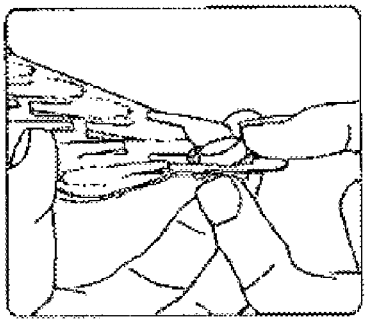

FIG. 1 to FIG. 3 illustrate a first embodiment of a safety label according to the invention, which comprises a safety sublayer 10 and a base sublayer 11. Attached to the respective underside of the safety sublayer 10 and the base sublayer 11 is an adhesive layer 12, with the result that the base sublayer 11 can be adhesively bonded to an individual packaging 13 and the safety sublayer 10 can be adhesively bonded to the base sublayer 11. The individual packaging 13 comprises a medicament receiving means 14 formed from a dimensionally stable plastic in which a number of medicament troughs are formed, with a single medicament 16 being placed in each medicament trough 15. Adhesively bonded to the medicament receiving means 14 is an aluminum foil 17, such that the medicaments 16 in the medicament trough 15 are kept reliable and, if appropriate, also sterile.

As can be gathered in particular from FIG. 2, a number of cuts 18 are provided in the safety sublayer 10, wherein these cuts 18 are located on a virtual cutting path. Said cuts 18 define a pull-off element 19 which is arranged in each case in the region of the associated medicament trough 15. It is possible, owing to the cuts 18 placed, to remove the pull-off element 19 completely from the safety sublayer 10. As can be gathered in particular from FIG. 3, a silicone varnish 20 is applied on the base sublayer 11 in the region of the pull-off element 19, such that the safety sublayer 10 exhibits only low adhesive action in the region of said silicone varnish 20. This aids the removal of the pull-off element 19 because the pull-off element 19 is held to the base sublayer 11 only by a very weak adhesive bond.

In a portion which is oriented toward the center of the individual packaging 13, a gripping lug 21 is formed on the pull-off element 19. This gripping lug 21 is formed by a continuous cut 18. A holding lug 22 is formed on one side of the pull-off element 19, with a curve 23 in the form of an indentation being formed between the actual pull-off element 19 and the holding lug 22.

The cuts 18 are oriented in the direction of the virtual cutting path. Moreover, retaining webs 24 and cross cuts 25 are placed on the virtual cutting path, with a retaining web 24 always being bounded by a cross cut 25 and a cut 18. Said retaining webs 24, cross cuts 25 and the curve form what are referred to as impeding areas, which are intended to impede the straightforward and uncontrolled pulling-off of the pull-off element 19. The pulling-off of the pull-off element 19 is also made more difficult on account of the virtual cutting path extending such that it is curved by 90° on that side of the pull-off element 19 that is located opposite the holding lug 22.

Provided in the base sublayer 11 are, on a virtual circular path (not illustrated in more detail here), T-shaped opening cuts 26, with three T-shaped opening cuts 26 being provided in this embodiment for each medicament trough 15. The horizontal portions 27 of the T-shaped opening cuts 26 are arranged tangentially on the virtual segment of a circle, while the vertical portions 28 of the T-shaped opening cut 26 are oriented radially toward the center of the medicament trough 15. The three T-shaped opening cuts 26 provided here are in this case arranged on the virtual circular path to be equidistant such that the vertical portions 28 of the two outer opening cuts 26 are arranged virtually perpendicular to one another.

The virtual segment of a circle (not shown in the drawing) is arranged to be concentric with the edge (not illustrated in more detail here) of the medicament trough 15, with the distance between the virtual segment of a circle and the edge of the medicament trough 15 being chosen such that the medicament 16, when it is pushed out in the region of the virtual circular path, presses against the aluminum foil 17 and thus also against the base sublayer 11.

In another embodiment (not illustrated here), only a single T-shaped opening cut is provided for each medicament. In yet another embodiment (not illustrated here), it is also possible for two, four or five T-shaped opening cuts per medicament to be provided. This depends in particular on the resistance the manufacturer desires, because the resistance encountered when the medicament is pushed out decreases with the number of T-shaped opening cuts.

The individual packaging mentioned here can be, for example, a blister or a wallet, but also any other packaging of medicaments in which the medicaments are accommodated individually in a specified cavity.

In the embodiment illustrated here, the vertical portions 28 are configured to be just as long as the horizontal portions 27, with the portions 27, 28 being configured to be so small that adjacent opening cuts 26 have a clear distance between them. This distance should be at least half the length of the horizontal portion 27, as a result of which the vertical portion 28 is oriented in the direction of the center point of the medicament trough 15 while keeping a clear distance from it.

When the medicament 16 is pushed out of the individual packaging 13, the aluminum foil 17 and the base sublayer 11 must be pierced. If an attempt is made to push the medicament through in a region in which no T-shaped opening cuts 26 are provided, a patient of normal strength will not succeed. However, if the medicament 16 is pushed through in the region of the T-shaped opening cuts 26, the resistance at this point is lowered and thus a patient of normal strength will succeed in piercing the aluminum foil 17 and the regions of the base sublayer 11 remaining outside the T-shaped opening cuts 26 in order to remove the medicament 16. In this manner, a certain resistance to removal of the medicament by a child is attained and accidental pushing out of the medicaments 16 also becomes nearly impossible.

The safety label according to the invention, illustrated in FIG. 1 to FIG. 3, enables even weak patients to remove the pull-off element 19 and push the medicament 16 through the aluminum foil 17 and the base sublayer 11 with relatively little application of force, because the patient is able, owing to his knowledge and his motor skills, to pull off the pull-off element 19 along the virtual cutting path and to push the medicament 16 out through the base sublayer in the region of the opening cuts 26. A child, on the other hand, will not easily be able to do this since his/her motor skills are not yet sufficiently developed. Accidental opening of the individual packaging 13 is nearly impossible, too, since the base sublayer 11 and the safety sublayer 10 provide very good protection here.

Figure 5:
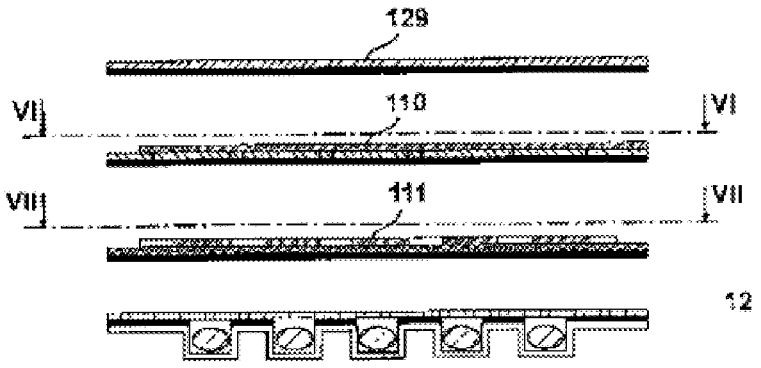
FIG. 5 shows an exploded view, illustrated in cross-section, of a second embodiment of a safety label according to the invention with blister packaging, the cross-section being viewed along lines V-V in FIG. 6.
Figure 6:
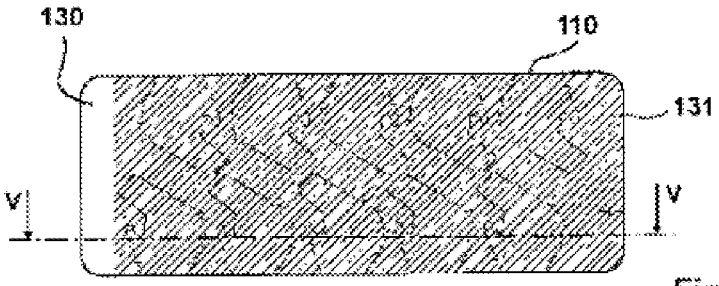
FIG. 6 shows a plan view of the safety sublayer of the safety label according to FIG. 5, viewed along lines VI-VI in FIG. 5.
Figure 7:
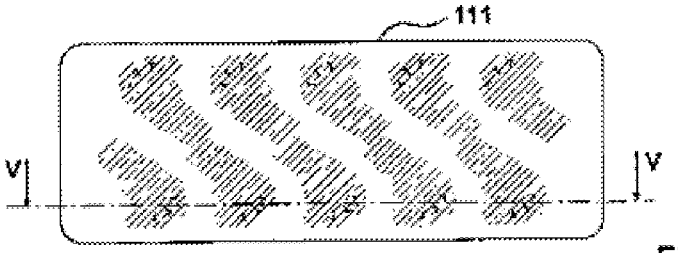
FIG. 7 shows a plan view of the base sublayer of the safety label according to FIG. 5, viewed along lines VII-VII in FIG. 5.

FIG. 5 to FIG. 7 illustrate a second embodiment of a safety label according to the invention, in which the base sublayer 111 and the safety sublayer 110 are identical to the base sublayer 11 and the safety sublayer 10 of the first embodiment according to FIG. 1 to FIG. 3. In the second embodiment, illustrated in FIG. 5 to FIG. 7, the only difference is that a cover sheet 129 is additionally adhesively bonded to the safety sublayer 110, which cover sheet 129 sticks permanently and non-detachably to the safety sublayer 110 in the region of a bond 130. In the remaining region of the safety sublayer 110, a silicone varnish 131 has been applied such that the cover sheet 129 exhibits only a low adhesion force in this region which is provided with silicone varnish 131. The cover sheet 129 can thus be pulled off the safety sublayer 110 and later be re-closed, with the result that the safety label always looks neat.

Figure 8:
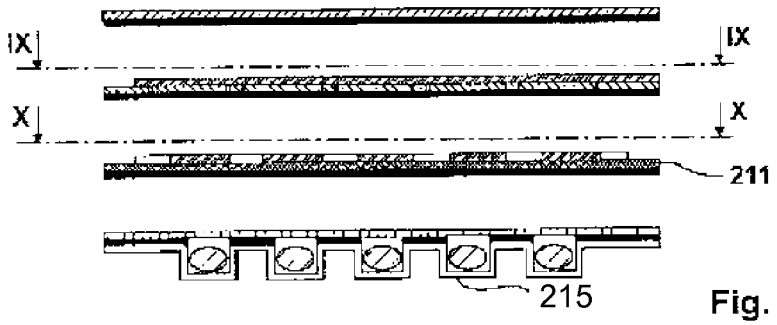
FIG. 8 shows an exploded view, illustrated in cross-section, of a third embodiment of a safety label according to the invention with blister packaging, the cross-section being viewed along section lines VIII-VIII in FIG. 9.
Figure 9:
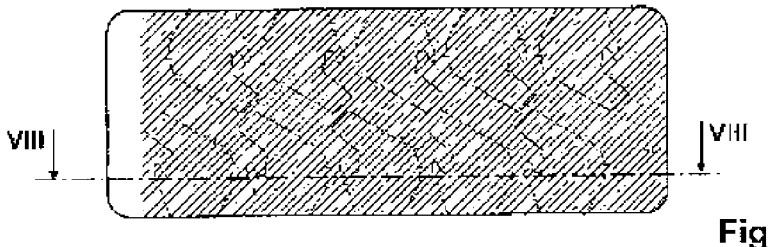
FIG. 9 shows a plan view of the safety sublayer of the safety label according to FIG. 8, viewed along lines IX-IX in FIG. 8.
Figure 10:
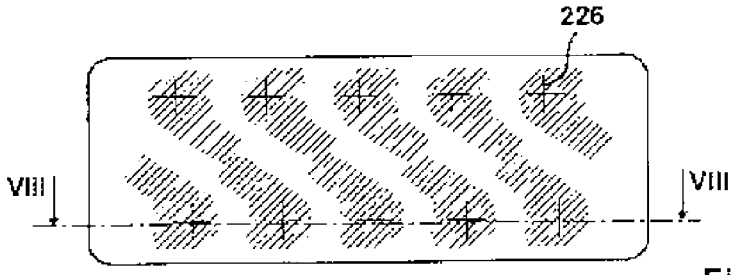
FIG. 10 shows a plan view of the base sublayer of the safety label according to FIG. 8, viewed along lines X-X in FIG. 8.

FIG. 8 to FIG. 10 illustrate a third embodiment of a safety label according to the invention, which is substantially identical to the second embodiment according to FIG. 5 to FIG. 7. The only difference is that the opening cuts 226 formed in the base sublayer 211 are cross cuts rather than T-shaped cuts. In this case, too, the opening cuts 226 are arranged in the center of the medicament trough 215, as is already known from the prior art.

The operation of removing the medicament will be explained in further detail below with reference to FIG. 4*a* to FIG. 4*f*: first, the cover sheet is gripped and pulled off the safety sublayer such that the cover sheet is adhesively bonded to the safety sublayer only at its bond. Subsequently the entire safety label together with the individual packaging can be held between thumb and index finger and thumb and index finger can be squeezed lightly together. In doing so, the center of the individual packaging curves slightly upward, as a result of which at least some gripping lugs of the pull-off elements partially lift off from the safety sublayer. Such a gripping lug can then be gripped in a simple manner in order then to remove the pull-off element 19. When the pull-off element is pulled off, the user quickly encounters a first impeding area in the form of a retaining web on one side of the pull-off element and a second impeding area in the form of a curve between the pull-off element and the holding lug. In order to pull off the pull-off element further, the pull-off direction would now have to be reversed in the region of the curve, which, however, is not practically possible. Consequently, the pull-off operation is interrupted at this point. If the user pulls again on the gripping lug, the retaining web is destroyed and the pull-off element is pulled off further along the virtual cutting path. Next, the user encounters a cross cut, which likewise represents an impeding area because, owing to the cross cut, the tendency is to divert the pull-off direction in the direction of the cross cut. A further retaining web is provided after this cross cut along the cutting path. Thus, if the user continues to pull on the gripping lug, this retaining web, too, is severed and the pull-off element can be pulled off further along the virtual cutting path. Owing to the curvature in the virtual cutting path, the user will then have to continue to pull off the pull-off element in a curved path, with the pull-off direction being rotated by 90°. This requires a certain amount of dexterity, since such a change in direction does not automatically take place. Once the change in direction is complete, the pull-off element can continue to be pulled off until the relevant side of the pull-off element is completely detached. Subsequently, the user can either continue to pull off the pull-off element in the region of the holding lug, or said pull-off element can be left attached here and pushed to the side. As can be gathered from FIG. 4*e*, it is subsequently possible by pressing on the medicament trough to push the actual medicament against the aluminum foil and to push it through the base sublayer. This is best done in the region of the T-shaped opening cuts, because the base sublayer is weakened in this region.

Initial tests have shown that, as a result of the combination of motor skills with the knowledge that the medicament can best be removed in the region of the opening cuts, this safety label cannot be opened by a child.

A method for pulling a pull-off element off a safety label which is applied on an individual packaging, is characterized in that the individual packaging is at least temporarily bent such that gripping lugs of the pull-off element become detached.

A method for pulling a pull-off element off a safety label which is applied on an individual packaging, is characterized in that, during the pull-off operation, the direction of the pull-off operation is changed by 30° to 120°, in particular by 70° to 100°, preferably by 90°.

A method for pulling a pull-off element off a safety label which is applied on an individual packaging, is characterized in that, during the pull-off operation, the pull-off direction is reversed, wherein the pull-off direction is changed by 140° to 200°, preferably by 160° to 180°.

A method for pulling a pull-off element off a safety label which is applied on an individual packaging, in particular according to one of the preceding methods, is characterized in that the pull-off operation along one side of the pull-off element is temporarily stopped so that the pull-off operation is carried out for the time being along another side of the pull-off element.

A method for pulling a pull-off element off a safety label which is applied on an individual packaging, in particular according to one of the preceding methods, is characterized in that the pull-off operation along a first side begins only after the pull-off operation along a second side is completed.

A method according to one of the preceding methods, is characterized in that the pull-off operation is subsequently completed on the first side.

LIST OF REFERENCE SIGNS

10, 110 safety sublayer
11, 111, 211 base sublayer
12 adhesive layer
13 individual packaging
13 medicament receiving means
15, 215 medicament trough
16 medicament
17 aluminum foil
18 cuts
19 pull-off element
20 silicone varnish
21 gripping lug
22 holding lug
23 curve
24 retaining webs
25 cross cut
26, 226 T-shaped opening cuts
27 horizontal portion

28 vertical portion
129 cover sheet
130 bond
131 silicone varnish

What is claimed is:

1. A safety label for protecting medicaments contained in an individual packaging comprising:

a base sublayer, a first side of the base sublayer being adhesively bonded onto the individual packaging, at least one opening cut being formed in the base sublayer in the region of a trough for each medicament, a safety sublayer adhesively bonded onto a second side of the base sublayer, the second side of the base sublayer being on an opposite side of the base sublayer from the first side of the base sublayer, pull-off elements formed in the safety sublayer in the region of each medicament trough associated with the pull-off elements to be pulled off the base layer, the pull-off elements being defined by cuts in the safety sublayer, the cuts being located at the edge of the pull-off elements, and the cuts being arranged on a virtual cutting path, and an impeding area provided on the cutting path, the impeding area acting as resistance to pulling off at least one of the pull-off elements, the impeding area being configured as at least one of a group of shapes comprising: (1) a transverse cut and (2) a curve with a strongly curved cutting path of more than 120°.

2. The safety label as claimed in claim 1, further comprising a retaining web and a transverse cut, the retaining web being arranged between the cuts and the transverse cut.

3. The safety label as claimed in claim 1, wherein the cutting path has a curved configuration, with the cutting path having a curvature of between 30° and 120°.

4. The safety label as claimed in claim 1, wherein the cutting path is configured to be strongly curved such that the pull-off direction is reversed, with the cutting path following a curve of 140° to 200°.

5. The safety label as claimed in claim 4, wherein the cutting path is configured to be strongly curved such that the pull-off direction is reversed, with the cutting path following a curve of 160° to 180°.

6. The safety label as claimed in claim 1, further comprising a gripping lug formed on at least one pull-off element included in the pull-off elements, wherein the gripping lug is completely surrounded by a cut or by a perforation.

7. The safety label as claimed in claim 6, further comprising a holding lug formed on the at least one pull-off element.

8. The safety label as claimed in claim 7, further comprising a U-shaped or V-shaped curve formed between the holding lug and the gripping lug.

9. The safety label as claimed in claim 8, wherein the gripping lug extends all the way into the curve.

10. The safety label as claimed in claim 7, wherein the at least one pull-off element has an edge of curved configuration on a side of the at least one pull-off element that is located opposite the holding lug.

11. The safety label as claimed in claim 1, wherein the at least one opening cut in the base sublayer is configured in the shape of a T.

12. The safety label as claimed in claim 11, wherein the at least one T-shaped opening cut comprises two, three or four T-shaped opening cuts provided in the region of a trough for each medicament.

13. The safety label as claimed in claim 12, wherein horizontal portions of the T-shaped opening cuts are arranged on a virtual segment of a circle.

14. The safety label as claimed in claim 13, wherein the virtual segment of the circle is concentric to the contour of a medicament trough of the individual packaging.

15. The safety label as claimed in claim 13, wherein the horizontal portions of the T-shaped opening cuts are located tangentially on the virtual segment of the circle, while vertical portions of the T-shaped opening cuts are oriented radially with respect to a center of the circle.

16. The safety label as claimed in claim 15, wherein the vertical portions of the T-shaped opening cuts are approximately 0.3 times to twice as long as the horizontal portions of the T-shaped opening cuts.

17. The safety label as claimed in claim 1, further comprising a cover sheet, which is predominantly detachable from the safety sublayer, the cover sheet being attached to the safety sublayer.

18. The safety label as claimed in claim 1, wherein the cutting path has a curved configuration, with the cutting path having a curvature of between 70° and 100°.

19. The safety label as claimed in claim 1, further comprising a release material which reduces or cancels adhesion force of the adhesive of the safety sublayer on the base sublayer in a region for each trough for each medicament enclosed by the cuts defining the pull-off elements.

20. The safety label as claimed in claim 19, wherein the release material is a silicone-containing varnish.

21. The safety label as claimed in claim 19, wherein the release material is applied on the base sublayer.

22. The safety label as claimed in claim 1, wherein the group of shapes further comprises at least one retaining web.

* * * * *